US012252974B2

(12) United States Patent
Kolbe et al.

(10) Patent No.: US 12,252,974 B2
(45) Date of Patent: Mar. 18, 2025

(54) EQUIPMENT HEALTH MONITOR

(71) Applicant: Schlumberger Technology Corporation, Sugar Land, TX (US)

(72) Inventors: Stuart Alan Kolbe, Stonehouse (GB); Ian Robert Farmer, Stonehouse (GB); Morven Collie, Stonehouse (GB); Andrew Whitmore, Stonehouse (GB); Darwin Amaya, Stonehouse (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 53 days.

(21) Appl. No.: 18/066,415

(22) Filed: Dec. 15, 2022

(65) Prior Publication Data

US 2024/0200436 A1 Jun. 20, 2024

Related U.S. Application Data

(60) Provisional application No. 63/289,666, filed on Dec. 15, 2021.

(51) Int. Cl.
*E21B 44/00* (2006.01)

(52) U.S. Cl.
CPC ..... *E21B 44/00* (2013.01)

(58) Field of Classification Search
CPC ..... E21B 44/00
See application file for complete search history.

(56) References Cited

U.S. PATENT DOCUMENTS

2005/0194182 A1* 9/2005 Rodney ..... E21B 47/12 175/24
2008/0205191 A1* 8/2008 Coste ..... G01V 1/42 367/25
2014/0121973 A1* 5/2014 Buchanan ..... G01M 5/0033 702/6
2015/0107901 A1* 4/2015 Eriksson ..... E21B 47/12 175/40
2018/0010445 A1* 1/2018 Cooper ..... E21B 47/12
2019/0264545 A1* 8/2019 Camacho Cardenas ..... G05B 15/02
2021/0262340 A1* 8/2021 Moody ..... E21B 47/09
2021/0366256 A1* 11/2021 Michalopulos ..... E21B 44/00
2021/0372261 A1* 12/2021 Miller ..... G05B 13/0265
2022/0056799 A1* 2/2022 Johnson ..... E21B 44/00
2023/0023709 A1* 1/2023 Jamieson ..... E21B 44/00

* cited by examiner

*Primary Examiner* — Amine Benlagsir
(74) *Attorney, Agent, or Firm* — Jeffrey D. Frantz

(57) ABSTRACT

A tool health manager may receive surface contextual data of the downhole drilling system. A tool health manager may receive downhole contextual data of the downhole drilling system, the downhole contextual data including downhole operating data for a downhole tool. A tool health manager may synchronize the downhole contextual data with the surface contextual data to generate synchronized data. A tool health manager may prepare a historical comparison between historical data and the synchronized data. A tool health manager may, based on the historical comparison, generate a tool health status of the downhole tool.

17 Claims, 7 Drawing Sheets

EQUIPMENT HEALTH MONITOR

CROSS-REFERENCE TO RELATED APPLICATIONS

This application claims priority to, and the benefit of, U.S. Patent Application Ser. No. 63/289,666, filed Dec. 15, 2021, the entirety of which in incorporated herein by reference.

BACKGROUND

Downhole drilling involves the drilling wellbores to access subterranean resources, such as oil, natural gas, water, and other natural resources. Downhole drilling involves the integration of multiple complex tools, including surface equipment, downhole tools, and auxiliary and/or support tools. To operate a downhole drilling system, a downhole driller may attempt to receive and process a significant amount of data. Because the downhole driller may not be able to process the entirety of the information, the downhole driller may use his or her knowledge base and experience to determine drilling activities to perform to maintain the health of the downhole tool and/or improve the rate of penetration (ROP) of the downhole drilling system.

SUMMARY

This document discloses an approach to evaluating the health of tools and equipment. The approach can be used to evaluate the health of tools used at a wellsite in support of oil and gas equipment. The equipment may be surface equipment or downhole equipment.

The solution may run on a computing device at the wellsite or in a remote operations center. For example, the solution may run on computers in a remote location and provide results that are accessible remotely (for example, via a browser) by a team at the wellsite or at a different location.

The solution may interpret downhole data points to evaluate tool condition and performance. The downhole data may be combined with contextual data—such as data from surface systems, a rig, business systems, or other downhole tools—to determine if, for example, there is a risk to the well delivery process. This solution may provide benefits such as a shortened response time and better decision making. The solution may make recommendations on how to improve performance, mitigate failures, or enter into a 'limp home' mode that manages the health of the tool to reach well total depth. These can be fed back to a user or form part of an automated, closed-loop control process.

A real-time health advisor solution may be used alongside automation solutions and planning solutions to allow these systems to account for tool health in the execution and planning process.

This summary introduces some of the concepts that are further described below in the detailed description. Other concepts and features are described below. The claims may include concepts in this summary or other parts of the description.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which.

DETAILED DESCRIPTION

Figure 1:
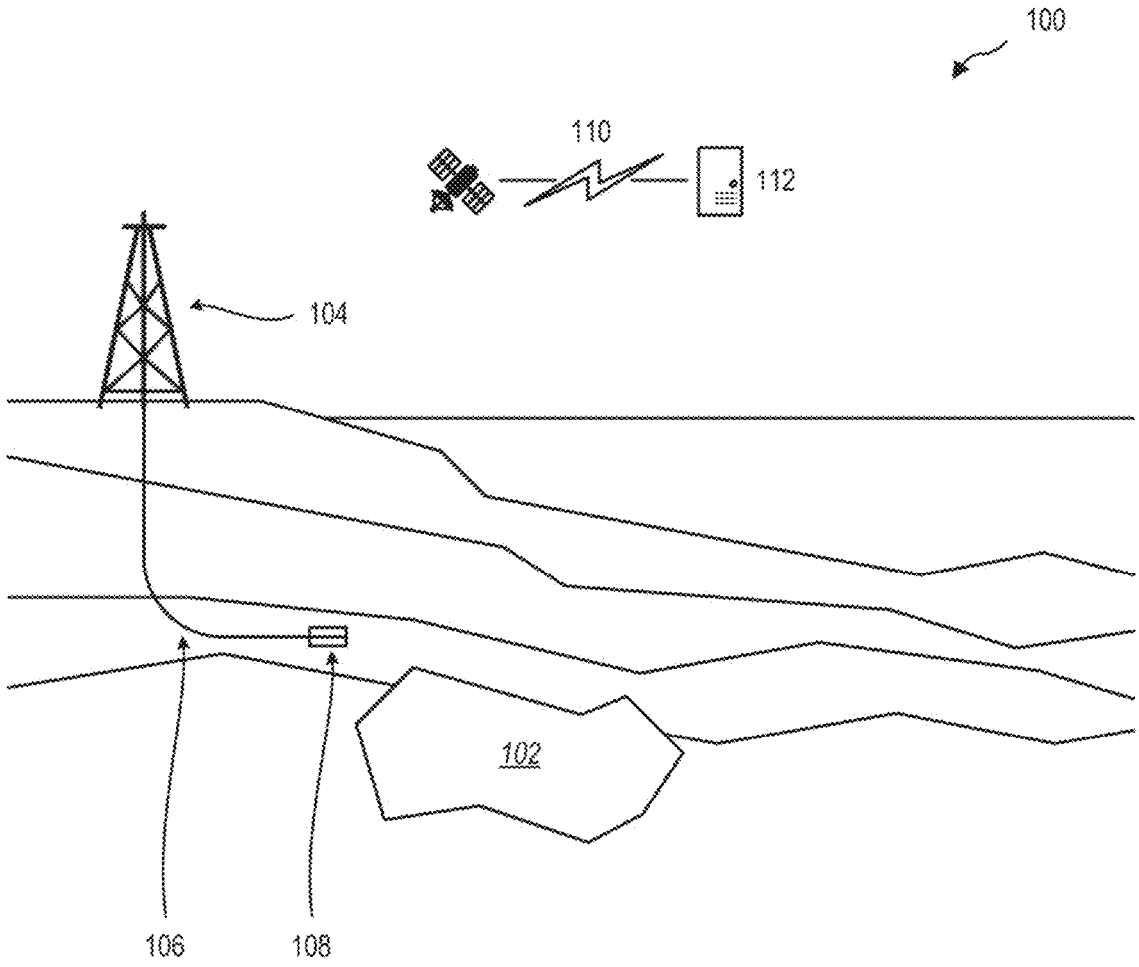
FIG. 1 is a representation of a drilling environment, according to at least one embodiment of the present disclosure.

The following detailed description refers to the accompanying drawings. Wherever convenient, the same reference numbers are used in the drawings and the following description to refer to the same or similar parts. While several embodiments and features of the present disclosure are described herein, modifications, adaptations, and other implementations are possible, without departing from the spirit and scope of the present disclosure.

Although the terms "first", "second", etc. may be used herein to describe various elements, these terms are used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

FIG. 1 illustrates one example of an environment 100 in which drilling may occur. The environment 100 may include a reservoir 102 and various geological features, such as stratified layers. The geological aspects of the environment 100 may contain other features such as faults, basins, and others. The reservoir 102 may be located on land or offshore.

The environment 100 may be outfitted with sensors, detectors, actuators, etc. to be used in connection with the drilling process. FIG. 1 illustrates equipment 104 associated with a well 106 being constructed using downhole equipment 108. The downhole equipment 108 may be, for example, part of a bottom hole assembly (BHA). The BHA may be used to drill the well 106. The downhole equipment 108 may communicate information to the equipment 104 at the surface, and may receive instructions and information from the surface equipment 104 as well. The surface equipment 104 and the downhole equipment 108 may communicate using various communications techniques, such as mud-pulse telemetry, electromagnetic (EM) telemetry, or others depending on the equipment and technology in use for the drilling operation.

The surface equipment 104 may also include communications means to communicate over a network 110 to remote computing devices 112. For example, the surface equipment 104 may communicate data using a satellite network to computing devices 112 supporting a remote team monitoring and assisting in the creation of the well 106 and other wells in other locations. Depending on the communications infrastructure available at the wellsite, various communications equipment and techniques (cellular, satellite, wired Internet connection, etc.) may be used to communicate data from the surface equipment 104 to the remote computing devices 112. In some embodiments, the surface equipment 104 sends data from measurements taken at the surface and measurements taken downhole by the downhole equipment 108 to the remote computing devices 112.

During the well construction process, a variety of operations (such as cementing, wireline evaluation, testing, etc.) may also be conducted. In such embodiments, the data collected by tools and sensors and used for reasons such as reservoir characterization may also be collected and transmitted by the surface equipment 104.

In FIG. 1, the well 106 includes a substantially horizontal portion (e.g., lateral portion) that may intersect with one or more fractures. For example, a well in a shale formation may pass through natural fractures, artificial fractures (e.g., hydraulic fractures), or a combination thereof. Such a well may be constructed using directional drilling techniques as described herein. However, these same techniques may be used in connection with other types of directional wells (such as slant wells, S-shaped wells, deep inclined wells, and others) and are not limited to horizontal wells.

The downhole equipment 108 may include one or more downhole tools. The downhole tools may be configured to perform a particular job. For example, a downhole tool may include a bit, and the bit may be configured to advance a wellbore depth of the wellbore. The downhole tool may include any downhole tool. For example, the downhole tool may include a bit, a reamer, a casing cutter, a rotary steerable system (RSS), a rotary stabilizer, an expandable tool, any other downhole tool, and combinations thereof.

During operation, the downhole tool may experience wear. Wear on the downhole tool may impact its ability to perform its associated job. For example, wear on a bit may cause one or more cutting elements on the bit to experience a reduced capacity to cut the rock. In some situations, the downhole tool may wear to the point that it cannot complete the job. This may cause the downhole driller to trip the downhole tool out of the well 106, thereby causing a delay in the completion of the well 106.

Conventionally, a drilling operator may receive surface drilling information and downhole drilling information and determine the status of the downhole drilling system. This determination may be based on the drilling operator's experience, knowledge, and intuition. But to effectively make drilling decisions, the drilling operator should be experienced and knowledgeable. Further, the amount of surface and downhole drilling information may be significant, including tens of variables and thousands, millions, billions, or more of datapoints. Such volume and variety of data is impractical for a single operator to receive and effectively review. As such, the drilling operator may tend to focus on a limited number of variables and datapoints and/or use his or her "gut" to intuit a drilling action. this may result in variability of response. For example, an operator may vary in response to similar datasets, and a set of operators when presented with the same information may make different drilling recommendations. This may result in a decrease in drilling efficiency and/or inconsistent responses to drilling conditions.

In accordance with at least one embodiment of the present disclosure, a downhole drilling system may include a tool health manager. The tool health manager may determine the tool health status of the downhole equipment 108. The tool health status may be an indication of the state of the downhole equipment 108. For example, the tool health status may be a representation of the amount of wear experienced by the downhole equipment 108. In some examples, the tool health status may be a representation of the functionality of the downhole equipment 108. In some examples, the tool health status may be a representation of how capable the downhole equipment 108 may be of performing the assigned task.

The tool health manager may provide the tool health status to an operator. The operator may utilize the tool health status to make drilling decisions. For example, using the tool health status, the operator may determine whether to trip the downhole equipment 108 out of the well 106 to repair and/or replace the downhole equipment 108. In some examples, using the tool health status, the operator may determine whether to change one or more drilling properties. For example, using the tool health status the operator may determine to change one or more surface drilling parameters. In some examples, using the tool health status, the operator may determine to change one or more downhole drilling parameters. In this manner, the drilling operator may increase the efficiency of the drilling system and/or improve the operational life of the downhole equipment 108.

In some embodiments, the tool health manager may prepare a drilling recommendation. For example, the tool health manager may prepare a drilling recommendation including one or more recommendations to change a drilling parameter. In some embodiments, the drilling recommendation may include a recommendation to trip the downhole equipment 108 out of the well 106. The tool health manager may generate a consistent response between wellbores that experience similar drilling conditions. In this manner, the tool health manager may help to improve drilling efficiency and consistency in drilling responses.

In some embodiments, the drilling recommendation may include a forecast. The forecast may include an anticipated or forecast tool health of the downhole tool using a given set of conditions. The forecast may incorporate contextual information of the wellbore, such as wellbore depth, formation information, and so forth. In some embodiments, the forecast may recommend drilling with a downhole tool that has a poor tool health status to finish the job. For example, a tool health status may indicate that the downhole equipment 108 is at risk of critical damage. The forecast may indicate that there is a short amount of time or distance remaining to reach a target depth and/or target status. Using the forecast, the drilling recommendation may recommend that the downhole tool continue to operate with the poor tool health status to achieve the target depth and/or target status. This may help to avoid and/or reduce unnecessary trips out of the well 106.

In some embodiments, the tool health manager may prepare the tool health status using historical information. For example, the tool health manager may prepare the tool health status using historical information from offset wellbores. In some examples, the offset wellbores may have the same or similar geological or other conditions as the well 106. In some examples, the tool health manager may prepare the tool health status using contextual information of the same or similar surface equipment 104 and/or downhole equipment 108.

Figure 2:
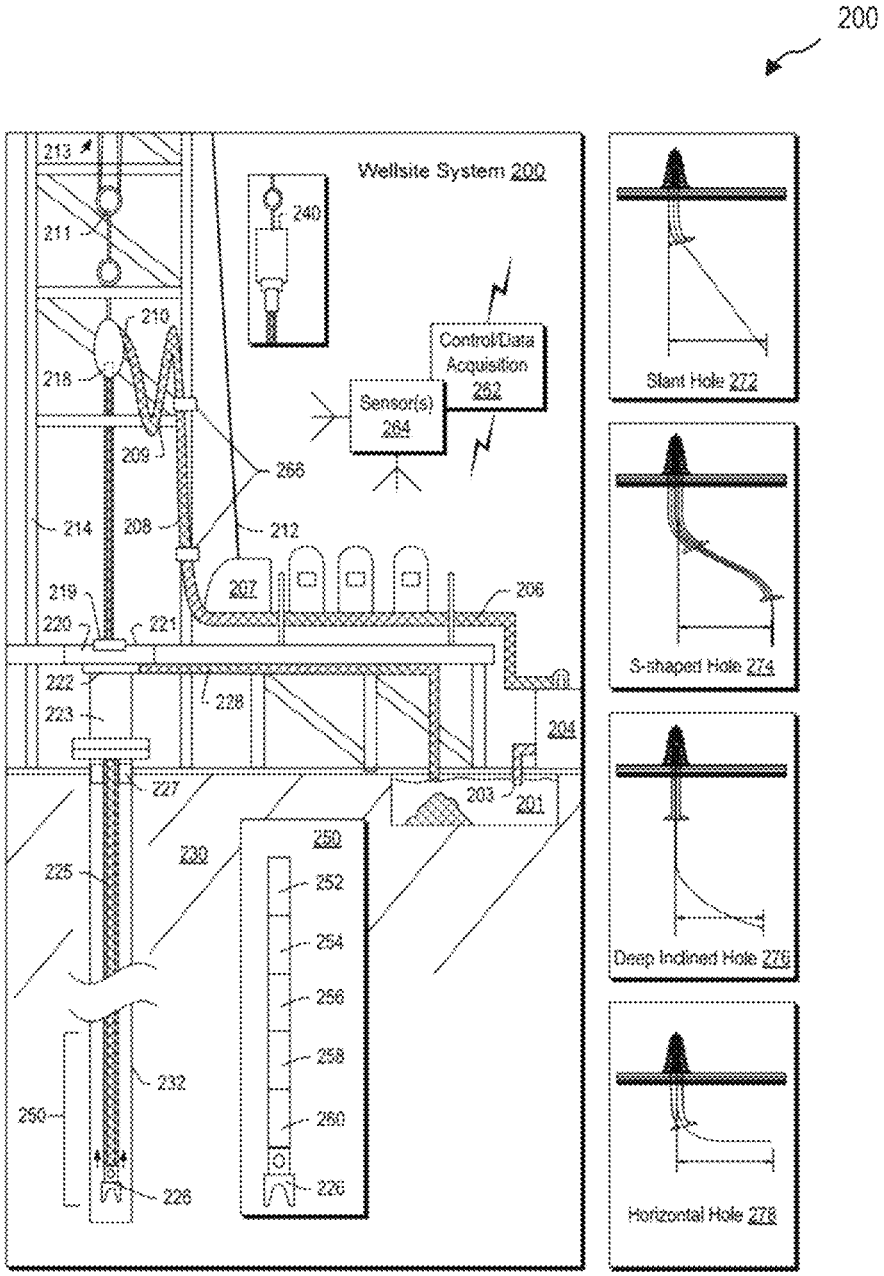
FIG. 2 is a representation of an example of a wellsite system, according to at least one embodiment of the present disclosure.

FIG. 2 shows an example of a wellsite system 200 (e.g., at a wellsite that may be onshore or offshore). As shown, the wellsite system 200 can include a mud tank 201 for holding mud and other material (e.g., where mud can be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212, a derrick 214, a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use one or more directional drilling techniques, equipment, etc.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 can provide for operation of the drillstring 225 and other operations. As shown, the wellsite system 200 includes the traveling block 211 and the derrick 214 positioned over the borehole 232. As mentioned, the wellsite system 200 can include the rotary table 220 where the drillstring 225 pass through an opening in the rotary table 220.

As shown in the example of FIG. 2, the wellsite system 200 can include the kelly 218 and associated components, etc., or a top drive 240 and associated components. As to a kelly example, the kelly 218 may be a square or hexagonal metal/alloy bar with a hole drilled therein that serves as a mud flow path. The kelly 218 can be used to transmit rotary motion from the rotary table 220 via the kelly drive bushing 219 to the drillstring 225, while allowing the drillstring 225 to be lowered or raised during rotation. The kelly 218 can pass through the kelly drive bushing 219, which can be driven by the rotary table 220. As an example, the rotary table 220 can include a master bushing that operatively couples to the kelly drive bushing 219 such that rotation of the rotary table 220 can turn the kelly drive bushing 219 and hence the kelly 218. The kelly drive bushing 219 can include an inside profile matching an outside profile (e.g., square, hexagonal, etc.) of the kelly 218; however, with slightly larger dimensions so that the kelly 218 can freely move up and down inside the kelly drive bushing 219.

As to a top drive example, the top drive 240 can provide functions performed by a kelly and a rotary table. The top drive 240 can turn the drillstring 225. As an example, the top drive 240 can include one or more motors (e.g., electric and/or hydraulic) connected with appropriate gearing to a short section of pipe called a quill, that in turn may be screwed into a saver sub or the drillstring 225 itself. The top drive 240 can be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 can hold mud, which can be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via the lines to a port of the kelly 218 or, for example, to a port of the top drive 240. The mud can then flow via a passage (e.g., or passages) in the drillstring 225 and out of ports located on the drill bit 226 (see, e.g., a directional arrow). As the mud exits the drillstring 225 via ports in the drill bit 226, it can then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud can be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may be modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measurement-while-drilling (MWD) module 256, an optional module 258, a rotary-steerable system (RSS) and/or motor 260, and the drill bit 226. Such components or modules may be referred to as tools where a drillstring can include a plurality of tools.

As to an RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling can commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor can present some challenges depending on factors such as rate of penetration (ROP), transferring weight to a bit (e.g., weight on bit, WOB) due to friction, etc. A mud motor can be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM) may be determined by use of the surface equipment and a downhole RPM of the mud motor may be determined using various factors related to drilling fluid flow rate, mud motor type, etc. As an example, in the combined rotating mode, bit RPM can be determined or estimated as a sum of the SRPM and the mud motor RPM, assuming the SRPM and the mud motor RPM are in the same direction.

As an example, a PDM mud motor can operate in a so-called sliding mode, when the drillstring is not rotated from the surface. In such an example, a bit RPM can be determined or estimated based on the RPM of the mud motor.

An RSS can drill directionally where there is continuous rotation from surface equipment, which can alleviate the sliding of a steerable motor (e.g., a PDM). An RSS may be deployed when drilling directionally (e.g., deviated, horizontal, or extended-reach wells). An RSS can aim to minimize interaction with a borehole wall, which can help to preserve borehole quality. An RSS can aim to exert a relatively consistent side force akin to stabilizers that rotate with the drillstring or orient the bit in the desired direction while continuously rotating at the same number of rotations per minute as the drillstring.

The LWD module 254 may be housed in a suitable type of drill collar and can contain one or a plurality of selected types of logging tools. It will also be understood that more than one LWD and/or MWD module can be employed, for example, as represented at by the module 256 of the drillstring assembly 250. Where the position of an LWD module is mentioned, as an example, it may refer to a module at the position of the LWD module 254, the module 256, etc. An LWD module can include capabilities for measuring, processing, and storing information, as well as for communicating with the surface equipment. In the illustrated example, the LWD module 254 may include a seismic measuring device.

The MWD module 256 may be housed in a suitable type of drill collar and can contain one or more devices for measuring characteristics of the drillstring 225 and the drill bit 226. As an example, the MWD module 256 may include equipment for generating electrical power, for example, to power various components of the drillstring 225. As an example, the MWD module 256 may include the telemetry equipment 252, for example, where the turbine impeller can generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation can include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well can include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring can include a positive displacement motor (PDM).

As an example, a system may be a steerable system and include equipment to perform a method such as geosteering. As mentioned, a steerable system can be or include an RSS. As an example, a steerable system can include a PDM or of a turbine on a lower part of a drillstring which, just above a drill bit, a bent sub can be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment can make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, can allow for implementing a geosteering method. Such a method can include navigating a subsurface environment, for example, to follow a desired route to reach a desired target or targets.

As an example, a drillstring can include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 can include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensors may be at an offset wellsite where the wellsite system 200 and the offset wellsite are in a common field (e.g., oil and/or gas field).

As an example, one or more of the sensors 264 can be provided for tracking pipe, tracking movement of at least a portion of a drillstring, etc.

As an example, the wellsite system 200 can include one or more sensors 266 that can sense and/or transmit signals to a fluid conduit such as a drilling fluid conduit (e.g., a drilling mud conduit). For example, in the wellsite system 200, the one or more sensors 266 can be operatively coupled to portions of the standpipe 208 through which mud flows. As an example, a downhole tool can generate pulses that can travel through the mud and be sensed by one or more of the one or more sensors 266. In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the wellsite system 200 can include a transmitter that can generate signals that can be transmitted downhole via mud (e.g., drilling fluid) as a transmission medium.

As an example, one or more portions of a drillstring may become stuck. The term stuck can refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this can refer to a portion of a drillstring that cannot be rotated or moved axially. As an example, a condition referred to as "differential sticking" can be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking can have time and financial cost.

As an example, a sticking force can be a product of the differential pressure between the wellbore and the reservoir and the area that the differential pressure is acting upon. This means that a relatively low differential pressure (delta p) applied over a large working area can be just as effective in sticking pipe as can a high differential pressure applied over a small area.

As an example, a condition referred to as "mechanical sticking" can be a condition where limiting or prevention of motion of the drillstring by a mechanism other than differential pressure sticking occurs. Mechanical sticking can be caused, for example, by one or more of junk in the hole, wellbore geometry anomalies, cement, keyseats or a buildup of cuttings in the annulus.

In accordance with at least one embodiment of the present disclosure, the wellsite system 200 may prepare a tool health status of one or more of the downhole tools from the drillstring assembly 250. The tool health status of the downhole tools from the drillstring assembly 250 may indicate the status of the downhole tool. For example, the tool health status may be a representation of the amount of wear on the downhole tool, the efficiency and/or effectiveness of the downhole tool, any other tool health status, and combinations thereof.

To determine the tool health status, a tool health manager may receive drilling information and/or contextual information from the wellsite system 200. For example, the data acquisition system 262 may receive data from the sensors 264 and the sensors 266. In some embodiments, the data from the sensors 264, 266 may be information regarding the surface equipment, including any of the surface equipment discussed herein. The data acquisition system 262 may receive the data from the sensors 264, 266 and transmit the information to the tool health manager.

In some embodiments, the data acquisition system 262 may receive downhole drilling information regarding the drillstring assembly 250. For example, the telemetry equipment 252 may transmit information from the drillstring assembly 250 uphole. The data acquisition system 262 may receive the transmitted downhole drilling information and transmit the downhole drilling information to the tool health manager.

Using the surface drilling information and the downhole drilling information received from the data acquisition system 262, the tool health manager may prepare a tool health status. The tool health status may be based on the downhole drilling information and/or the surface drilling information. In some embodiments, the tool health status may be a tool health status for any of the downhole tools in the drillstring assembly 250. In some embodiments, the tool health status may be for any of the surface equipment described and illustrated herein.

Figure 3:
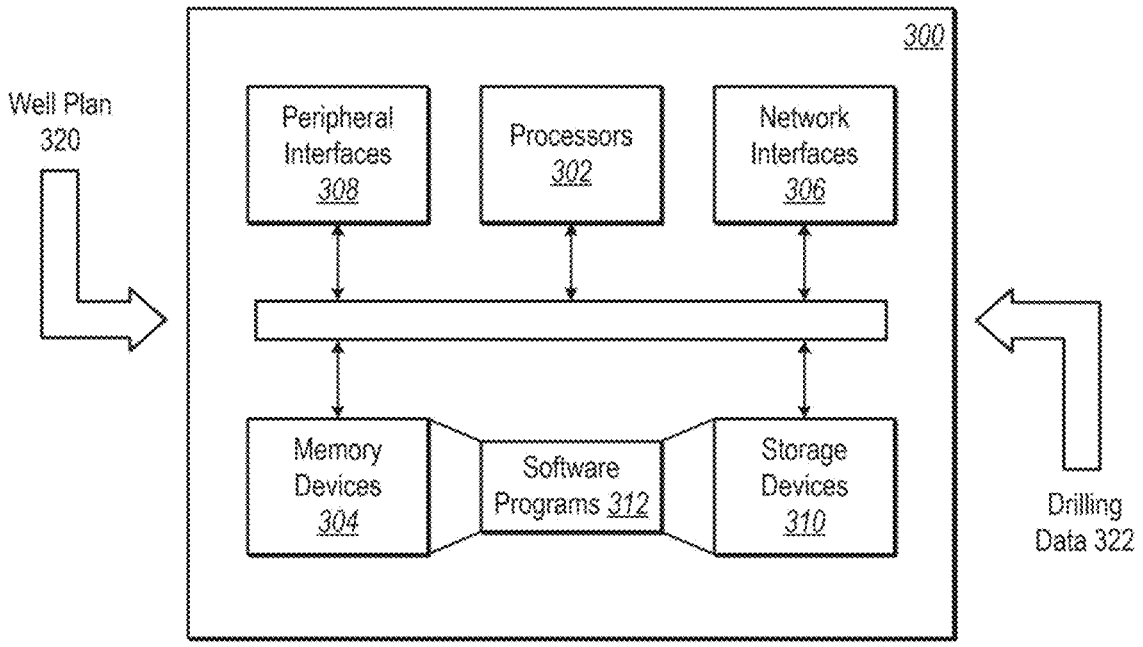
FIG. 3 is a schematic view of a computing or processing system configured to implement aspects of the tool health manager of the present disclosure, according to at least one embodiment of the present disclosure.

FIG. 3 is a schematic view of such a computing or processor system 300 configured to implement the tool health manager of the present disclosure, according to an embodiment. The processor system 300 may include one or more processors 302 of varying core configurations (including multiple cores) and clock frequencies. The one or more processors 302 may be operable to execute instructions, apply logic, etc. It will be appreciated that these functions may be provided by multiple processors or multiple cores on a single chip operating in parallel and/or communicably linked together. In at least one embodiment, the one or more processors 302 may be or include one or more GPUs.

The processor system 300 may also include a memory system, which may be or include one or more memory devices and/or computer-readable media 304 of varying physical dimensions, accessibility, storage capacities, etc. such as flash drives, hard drives, disks, random access memory, etc., for storing data, such as images, files, and program instructions for execution by the processor 302. In an embodiment, the computer-readable media 304 may store instructions executable by the processor 302 that, when executed by the processor 302, are configured to cause the processor system 300 to perform operations. For example, execution of such instructions may cause the processor system 300 to implement one or more portions and/or embodiments of the method(s) described above.

The processor system 300 may also include one or more network interfaces 306. The network interfaces 306 may include any hardware, applications, and/or other software. Accordingly, the network interfaces 306 may include Ethernet adapters, wireless transceivers, PCI interfaces, and/or serial network components, for communicating over wired or wireless media using protocols, such as Ethernet, wireless Ethernet, etc.

As an example, the processor system 300 may be a mobile device that includes one or more network interfaces for communication of information. For example, a mobile device may include a wireless network interface (e.g., operable via one or more IEEE 802.11 protocols, ETSI GSM, BLUETOOTH®, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

The processor system 300 may further include one or more peripheral interfaces 308, for communication with a display, projector, keyboards, mice, touchpads, sensors, other types of input and/or output peripherals, and/or the like. In some implementations, the components of processor system 300 need not be enclosed within a single enclosure or even located in close proximity to one another, but in other implementations, the components and/or others may be provided in a single enclosure. As an example, a system may be a distributed environment, for example, a so-called "cloud" environment where various devices, components, etc. interact for purposes of data storage, communications, computing, etc. As an example, a method may be implemented in a distributed environment (e.g., wholly or in part as a cloud-based service).

As an example, information may be input from a display (e.g., a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

The computer-readable media 304 may be physically or logically arranged or configured to store data on one or more storage devices 310. The storage device 310 may include one or more file systems or databases in any suitable format. The storage device 310 may also include one or more software programs 312, which may contain interpretable or executable instructions for performing one or more of the disclosed processes. When requested by the processor 302, one or more of the software programs 312, or a portion thereof, may be loaded from the storage devices 310 to the computer-readable media 304 for execution by the processor 302.

Those skilled in the art will appreciate that the above-described componentry is merely one example of a hardware configuration, as the processor system 300 may include any type of hardware components, including any accompanying firmware or software, for performing the disclosed implementations. The processor system 300 may also be implemented in part or in whole by electronic circuit components or processors, such as application-specific integrated circuits (ASICs) or field-programmable gate arrays (FPGAs).

The processor system 300 may be configured to receive a directional drilling well plan 320. As discussed above, a well plan is to the description of the proposed wellbore to be used by the drilling team in drilling the well. The well plan typically includes information about the shape, orientation, depth, completion, and evaluation along with information about the equipment to be used, actions to be taken at different points in the well construction process, and other information the team planning the well believes will be relevant/helpful to the team drilling the well. A directional drilling well plan will also include information about how to steer and manage the direction of the well.

The processor system 300 may be configured to receive drilling data 322. The drilling data 322 may include data collected by one or more sensors associated with surface equipment or with downhole equipment. The drilling data 322 may include information such as data relating to the position of the BHA (such as survey data or continuous position data), drilling parameters (such as WOB), ROP, torque, or others), text information entered by individuals working at the wellsite, or other data collected during the construction of the well.

In one embodiment, the processor system 300 is part of a rig control system (RCS) for the rig. In another embodiment, the processor system 300 is a separately installed computing unit including a display that is installed at the rig site and receives data from the RCS. In such an embodiment, the software on the processor system 300 may be installed on the computing unit, brought to the wellsite, and installed and communicatively connected to the rig control system in preparation for constructing the well or a portion thereof.

In another embodiment, the processor system 300 may be at a location remote from the wellsite and receives the drilling data 322 over a communications medium using a protocol such as well-site information transfer specification or standard (WITS) and markup language (WITSML). In such an embodiment, the software on the processor system 300 may be a web-native application that is accessed by users using a web browser. In such an embodiment, the processor system 300 may be remote from the wellsite where the well is being constructed, and the user may be at the wellsite or at a location remote from the wellsite.

As discussed herein, many tools require a user (for example, a directional driller) to have wide-ranging knowledge, training and experience to use them in a successful way. When the tool is being used, the user needs to monitor the tool performance during the job to determine its health. For example, during a directional drilling operation, the directional driller needs to monitor multiple factors to determine whether the tool is healthy and performing adequately and sufficiently to hit the well target. This process of manually monitoring raw data and interpreting can frequently lead to inefficiency in decision making and introduce the risk of human error. For example, in directional drilling, there are a range of RSS tools available and each may require different interpretations of the data. This requires the directional driller to develop extensive knowledge and understanding of the behavior of different RSS tools (along with each tool's sources of information such as manuals, dpoint decoders, etc.) to reach appropriate conclusions.

Figure 4:
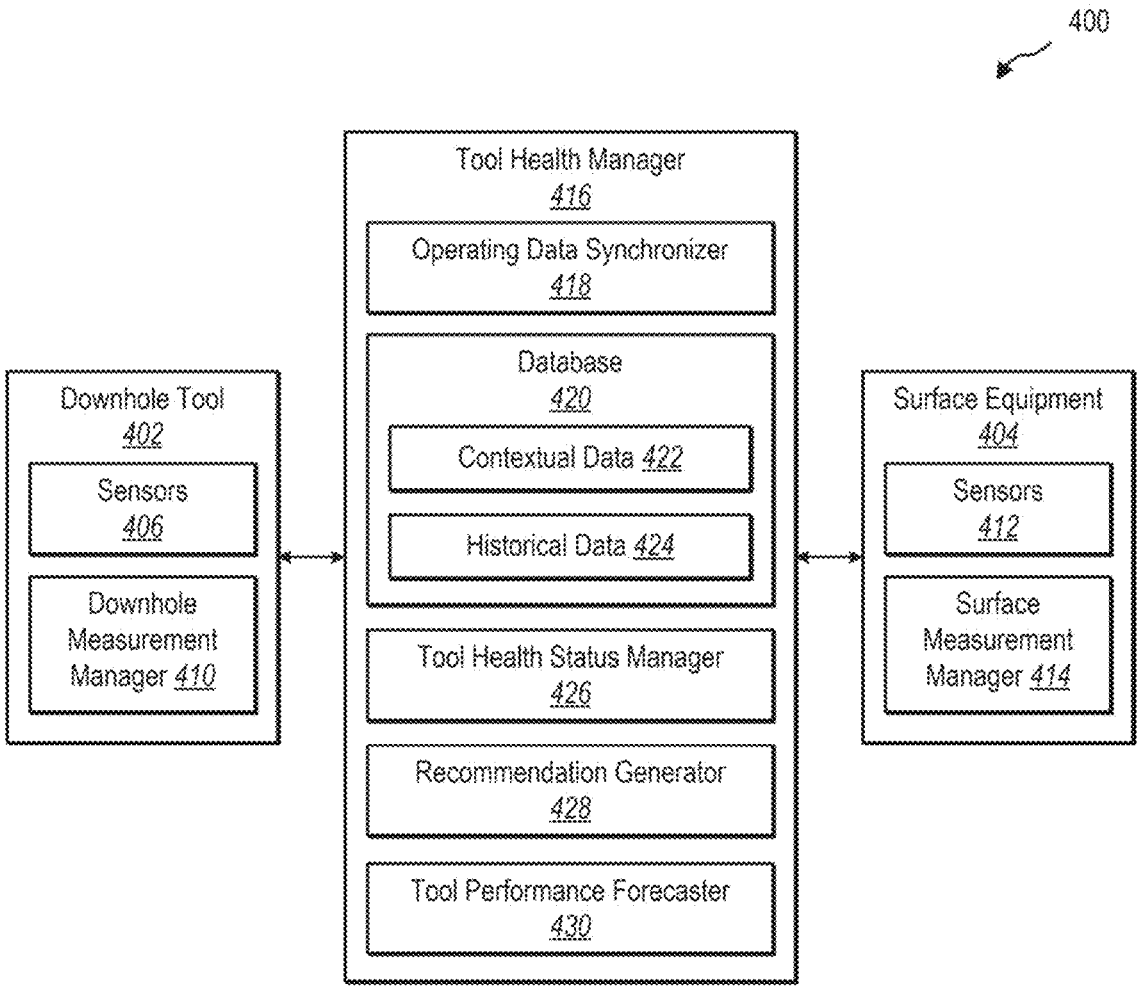
FIG. 4 is a representation of a real-time health analyzer (RTHA) system, according to at least one embodiment of the present disclosure.

FIG. 4 is a representation of a real-time health analyzer (RTHA) system 400, according to at least one embodiment of the present disclosure. Each of the components of the RTHA system 400 can include software, hardware, or both. For example, the components can include one or more instructions stored on a computer-readable storage medium and executable by processors of one or more computing devices, such as a client device or server device. When executed by the one or more processors, the computer-executable instructions of the RTHA system 400 can cause the computing device(s) to perform the methods described herein. Alternatively, the components can include hardware, such as a special-purpose processing device to perform a certain function or group of functions. Alternatively, the components of the RTHA system 400 can include a combination of computer-executable instructions and hardware.

Furthermore, the components of the RTHA system 400 may, for example, be implemented as one or more operating systems, as one or more stand-alone applications, as one or more modules of an application, as one or more plug-ins, as one or more library functions or functions that may be called by other applications, and/or as a cloud-computing model. Thus, the components may be implemented as a stand-alone application, such as a desktop or mobile application. Furthermore, the components may be implemented as one or more web-based applications hosted on a remote server. The components may also be implemented in a suite of mobile device applications or "apps."

During directional drilling activities, a directional driller may need to monitor and consider various datasets from both the surface and downhole. The RTHA system 400 receives data from a downhole tool 402 and surface equipment 404 and analyzes it to provide outputs such as warnings and recommended actions for the directional driller or automation system. In one embodiment, the RTHA system 400 uses a traffic light system to show which indicators are dormant, active, or to show a warning or recommendation for the directional driller to act on immediately.

The downhole tool 402 may include one or more downhole sensors 406. The one or more downhole sensors 406 may be sensors from any downhole tool, including the downhole tools from the drillstring assembly 250 of FIG. 2. A downhole measurement manager 410 may collect the measurements from the downhole sensors 406. In some embodiments, the measurements may include one or more of RT stat, RT mode, steering vector magnitude, steering vector angle, drilling envelope, RT fault detector, TRPM, motor HV, alternator HV, inclination, azimuth, tool angle, tool depth, any other downhole measurement, and combinations thereof. In some embodiments, the measurements may be indicative of downhole operating data. Put another way, downhole operating data may include one or more measurements from the downhole sensors 406.

The downhole measurement manager 410 may receive the downhole operating data from the downhole tool 402. In some embodiments, the downhole measurement manager 410 may transmit the downhole operating data to the RTHA system 400. For example, the downhole measurement manager 410 may transmit the downhole operating data to a surface location using the telemetry equipment 252 and/or any other transmission mechanism.

In some embodiments, the downhole measurement manager 410 may pre-process at least a portion of the downhole operating data prior to transmitting it to the surface. For example, the downhole measurement manager 410 may summarize and/or consolidate one or more of the datasets received from the downhole sensors 406. In some embodiments, the downhole measurement manager 410 may prepare the tool health status of the downhole tool 402 using the downhole operating data. In some embodiments, the downhole measurement manager 410 may prepare a preliminary tool health status of the downhole tool 402. For example, the downhole measurement manager 410 may prepare a preliminary tool health status based on the downhole operating data alone, without including surface operating information. In some embodiments, the downhole measurement manager 410 may include downhole contextual data, such as downhole location (as determined at the downhole tool 402 or by another downhole tool), downhole tool configuration, downhole tool specifications, any other downhole contextual data, and combinations thereof.

The surface equipment 404 may include surface sensors 412. The surface sensors 412 may receive surface operating data, such as drilling fluid flow rate, RPM, surface WOB, proximity to the PLN, proximity to offset wellbores, standpipe pressure, torque, pick-up and slack-off, any other surface operating data, and combinations thereof. A surface measurement manager 414 may receive the surface operating data from the surface sensors 412. The surface sensors 412 may periodically and/or episodically prepare the measurements of the surface operating data.

A tool health manager 416 may receive the surface operating data from the surface measurement manager 414 and the downhole operating data from the downhole measurement manager 410 and generate a tool health status. The tool health manager 416 may include an operating data synchronizer 418. The operating data synchronizer 418 may synchronize the surface operating data and the downhole operating data. For example, the operating data synchronizer 418 may synchronize the downhole operating data to the surface operating data based on any synchronizing factor. In some examples, the operating data synchronizer 418 may synchronize the downhole operating data to the surface operating data based on the measurement time, or the time at which the measurements were taken. In some examples, the operating data synchronizer 418 may synchronize the downhole operating data to the surface operating data based on wellbore depth. In some examples, the operating data synchronizer 418 may synchronize the downhole operating data to the surface operating data based on any combination of synchronization factors.

The tool health manager 416 includes a database 420 of drilling information. The database 420 may include any type of drilling information. For example, the database 420 may include contextual data 422. The contextual data 422 may include data not directly related to a measurement. Contextual data 422 may include information such as equipment type, equipment specifications, wellbore plan, geological formation information, any other contextual information, and combinations thereof. In some embodiments, the contextual data 422 may include surface contextual data regarding surface equipment and conditions. In some embodiments, the contextual data 422 may include downhole contextual data regarding downhole equipment and conditions.

The database 420 may further include historical data 424. The historical data 424 may include historical information relevant to the wellbore. For example, the historical data 424 may include historical information of the same wellbore. In some examples, the historical data 424 may include historical information for offset wellbores. The historical data 424 may include any combination of information, including historical surface operating data, historical downhole operating data, historical contextual information, any other historical information, and combinations thereof.

The tool health manager 416 may include a tool health status manager 426. The tool health status manager 426 may review the surface operating data, the downhole operating data, the contextual data 422, the historical data 424, any other information, and combinations thereof. Using the collected information, the tool health status manager 426 may prepare a tool health status for the downhole tool 402. As discussed herein, the tool health status may include an indication of the health or operating status of the downhole tool 402.

In some embodiments, the tool health status manager 426 may prepare a graduated tool health status. For example, the tool health status manager 426 may prepare a tool health status that is graduated between three categories. The categories, which may be color coded, may include poor (e.g., red), good (e.g., yellow), and great (e.g., green). The tool health status manager 426 may provide the tool health status to the drilling operator. The drilling operator may use the tool health status to determine one or more drilling actions to take based on the tool health status. For example, the drilling operator may take a drilling action to reduce wear on the downhole tool 402. In some examples, the drilling operator may take a drilling action to increase ROP of the wellbore.

The tool health status prepared by the tool health status manager 426 may help to improve the consistency and/or accuracy of the assessment of the downhole tool 402. For example, as discussed herein, different drilling operators, when presented with the same information may present different views on the tool health status. Because the tool health status manager 426 can analyze large amounts of data and compare the data in real time to the information in the database 420, the tool health status manager 426 may prepare consistent tool health statuses that incorporate all the operating data. This may help to reduce the overall operating expense of the wellbore by generating improved representations of the tool health.

The tool health manager 416 includes a recommendation generator 428. The recommendation generator 428 may generate one or more drilling recommendations associated with the tool health status. For example, the recommendation generator 428 may generate a drilling recommendation to change one or more drilling parameters. In some examples, the recommendation generator 428 may generate a drilling recommendation to change one or more surface drilling parameters, such as RPM, torque, drilling fluid pressure, surface WOB, any other surface drilling parameter, and combinations thereof. In some examples, the recommendation generator 428 may generate a drilling recommendation to change one or more downhole drilling parameters. In some examples, the recommendation generator 428 may generate a drilling recommendation to change the operating condition of a downhole tool.

As discussed herein, RTHA system 400 may support a range of tools. For example, it may support a range of RSS tools and provide a consistent user experience and interpretation across the tools. A simple interface may be created that provides an improved user experience and removes the need for manual interpretation, increasing the efficiency of the field personnel's decision making and time to act.

The ability to interpret context of an operation, such as a drilling environment, while analyzing and interpreting tool status and conditions may allow the RTHA system 400 to prepare a tool health status and/or generate drilling recommendations of actions that the user may take to improve the operation. The RTHA system 400 may highlight tool degradation and severity and highlight the impact on the operation.

The RTHA system 400 may use a combination of domain knowledge and machine learning derived from large volumes of data to create interpretations and recommendations. The RTHA system 400 may be made available to the wellsite team onsite at a wellbore (for example, a directional driller) and/or a remote operational support center (for example, a remote drilling engineer monitoring multiple wells). The RTHA system 400 may facilitate remote operations and/or lower the number of people who need to be deployed at the wellsite by allowing remote teams to monitor and make decisions for more wells.

The RTHA system 400 may combine data from multiple sources (downhole, surface, multiple tools, etc.) to gather context, check against the well plans, have redundancy in measurement, etc. The RTHA system 400 may also use this added context to move the indicator from tool health to well delivery risk, offering monitoring warnings if the tool is in a degraded mode but still performing. The RTHA system 400 may improve confidence in re-run decisions based on the latest known tool health (or a specifically designed re-run module), particularly where tool data cannot be removed from the tool itself at the wellsite (e.g., a tool dump) due to design or during remote operations where there are no trained personnel present.

In some embodiments, the RTHA system 400 may facilitate de-skilling certain aspects of operations and reduce the need for complicated training. It may facilitate consistent/timely decisions from the field population due to the tools having a common interface and providing a similar process for recommended actions.

The RTHA system 400 may be implemented as a distributed system with more computations done downhole using the higher frequency data and utilizing more channels, before transmitting information to the surface module to combine with contextual information and time/depth trending before raising flags and/or warnings.

As discussed herein, a method of operating the RTHA system 400 may include the tool generating data and interpreting the data. The tool may be a downhole tool. The downhole tool may collect the full data set and perform initial computations and analysis. The downhole tool may identify a subset of the data, including the calculated data, to transmit to the surface. The data may be transmitted via mud-pulse telemetry, wired drill pipe, or other suitable transmission method.

The downhole data may be merged and/or synchronized with the relevant surface data. In one embodiment, the data is synchronized in time such that the data from surface equipment and data from the downhole tool are using a common time.

The data may be distributed to various platforms. As discussed above, the data may be presented to the wellsite crew (for example, a driller) or to one or more remote personnel monitoring the job remotely. The merged data, which provides context for the surface and downhole, may be presented to give the user full context for the performance of the tool.

The data may be used to provide contextual probability for the performance of the tool. In one embodiment, the data is used to calculate the current life of the tool and expected performance for the tool. For example, the RTHA system 400 may include a tool performance forecaster 430. The tool performance forecaster 430 may calculate and/or forecast the expected performance of the tool. For example, the tool performance forecaster 430 may forecast the expected performance of the downhole tool for the duration of a run. Given that the tool performance may degrade over time, the system may update the drilling plan or schedule to account for the expected performance of the tool.

In some embodiments, the recommendation generator 428 may review the forecast from the tool performance forecaster 430 to prepare the drilling recommendation. For example, in some embodiments, the tool health status manager 426 may prepare a tool health status of poor health for the downhole tool. The tool performance forecaster 430 may prepare a forecast of an amount of time and/or distance that the downhole tool may drill before losing effectiveness and/or breaking. Based on the forecast and other information from the database 420, such as a target depth or other drilling goal, the tool performance forecaster 430 may determine whether the remaining tool life is sufficient to reach the target depth or other drilling goal. If the remaining tool life, based on the forecast, is sufficient to reach the target depth or other drilling goal, the recommendation generator 428 may prepare a drilling recommendation to continue drilling with the downhole tool. While this may damage the downhole tool, it may reduce the overall time to the target depth or other drilling goal. This may help to reduce the overall drilling time and/or drilling cost of the wellbore.

In some embodiments, the recommendation generator 428 may generate or determine suggested parameters for the tool based on goals. For example, a user may want to use the particular tool until a particular depth is reached. The tool health status manager 426 may determine an estimated health of the tool and the tool performance forecaster 430 may prepare an estimated lifespan for the tool. The recommendation generator 428 may suggest parameters that improve performance of the tool (for example, fastest time to a particular depth) while respecting health constrains entered by the user. For example, the user may indicate that once the tool reached a particular depth it will be tripped out and replaced. In such a case, the recommendation generator 428 may set parameters that will use the estimated remaining life of the tool (as determined by the tool performance forecaster 430) to reach the specified depth. In another embodiment, the user may prioritize reaching a particular depth with the tool even though it is towards the end of life. In such an embodiment, the recommendation generator 428 may recommend a conservative set of parameters that reduce the likelihood of tool failure before reaching the specified depth.

As discussed herein, the tool health manager 416 may use historical data 424 for the tool and machine learning to determine the anticipated life of the tool and make appropriate parameter recommendations. The RTHA system 400 may, for example, create machine learning models for the tool to predict its performance and set parameters that meet goals while preserving tool health as needed to accomplish those goals.

Figure 5:
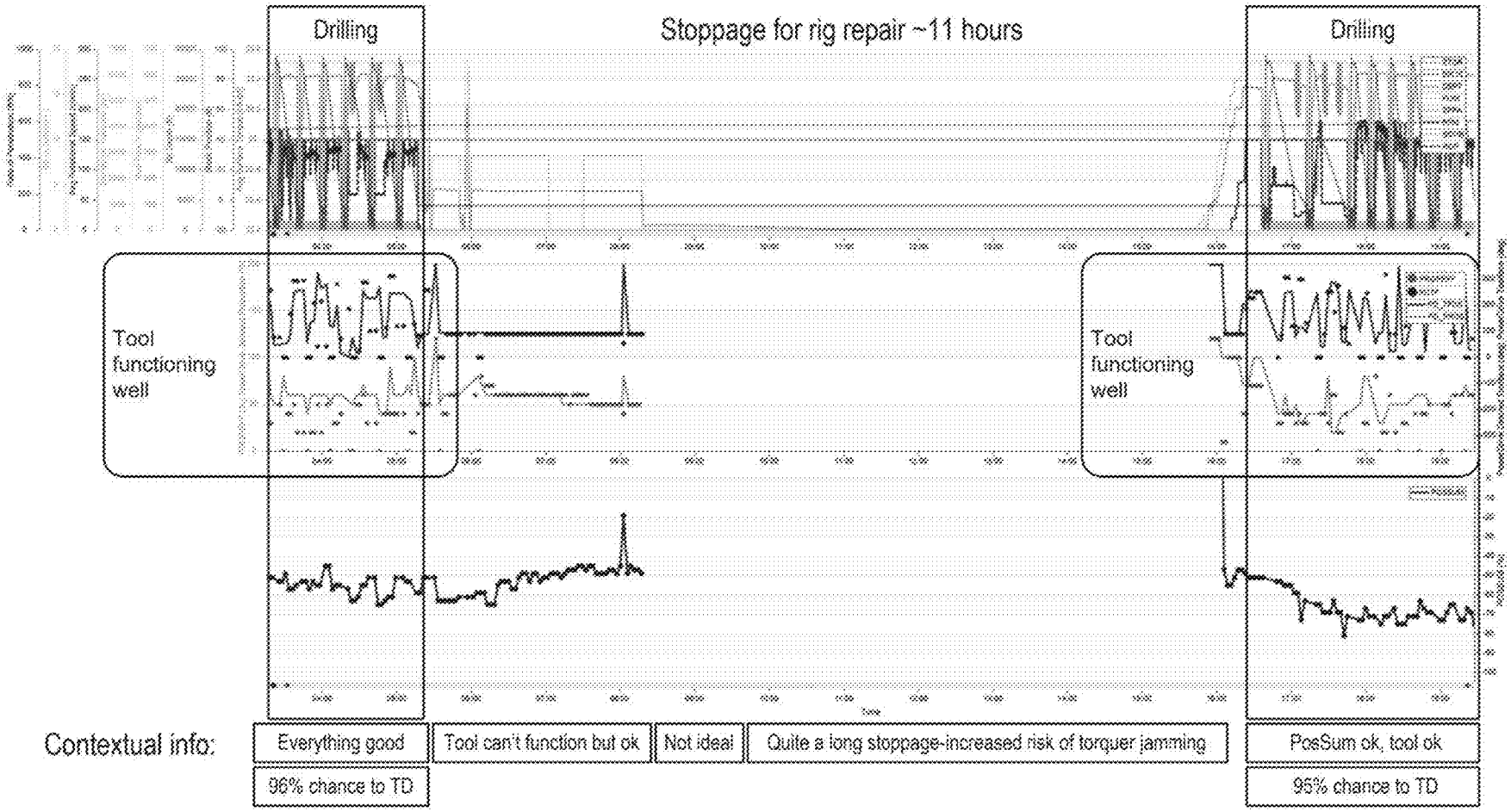
FIG. 5 is a representation of an example interface facilitating analysis of tool health and performance, according to at least one embodiment of the present disclosure.

FIG. 5 shows one example of an interface to facilitate analysis of tool health and performance. FIG. 5 shows data from the tool and the surface and provides context for the user. The bottom of the figures provides contextual information for the driller and/or any other users. For example, the interface shows a 96% chance of reaching the TD and illustrates the potential risks associated with the operations. For example, the interface shows an increasing risk of torquer jamming during a stoppage.

The solution described herein may also be applied to operations. For example, the approach may provide information about parameters and objectives for a particular operation at a wellsite and account for the health of the tools in assessing the risks of the operation. For example, as noted above, the solution may evaluate the risk of torquer jamming during a stoppage. Such an approach may be implemented independent of the particular tool being used based on the operational context.

Figure 6:
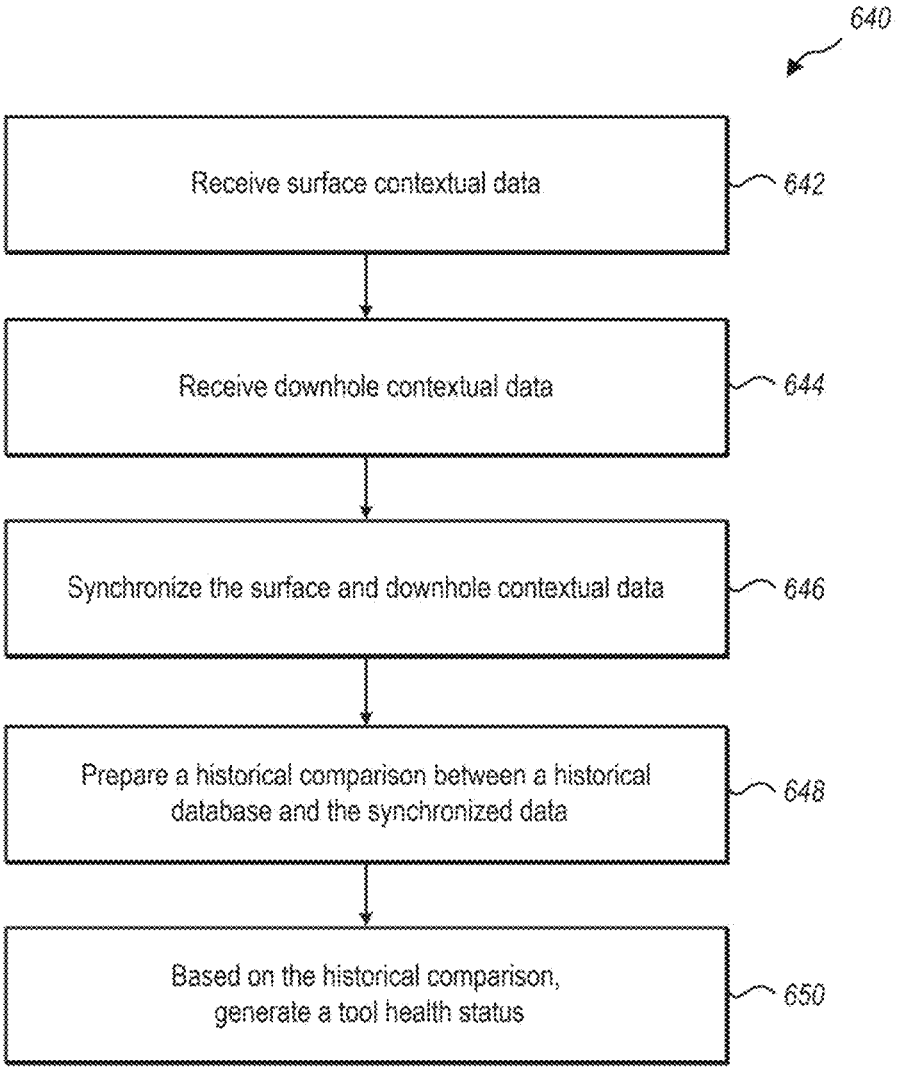
FIG. 6 is a flowchart of a method for managing a wellbore, according to at least one embodiment of the present disclosure.
Figure 7:
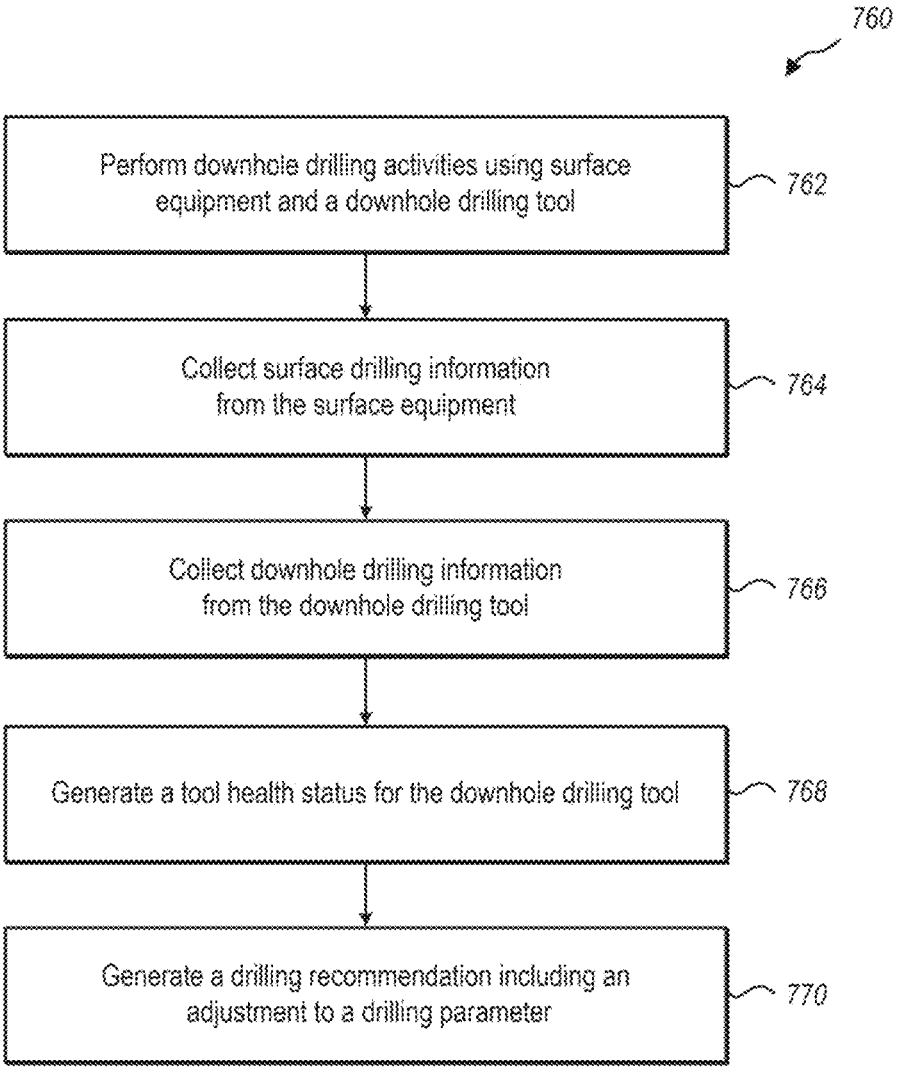
FIG. 7 is a flowchart of another method for managing a wellbore, according to at least one embodiment of the present disclosure.

FIGS. 6 and 7, the corresponding text, and the examples provide a number of different methods, systems, devices, and non-transitory computer-readable media of the RTHA system 400. In addition to the foregoing, one or more embodiments can also be described in terms of flowcharts comprising acts for accomplishing a particular result, as shown in FIGS. 6 and 7. FIGS. 6 and 7 may be performed with more or fewer acts. Further, the acts may be performed in differing orders. Additionally, the acts described herein may be repeated or performed in parallel with one another or parallel with different instances of the same or similar acts.

As mentioned, FIG. 6 illustrates a flowchart of a method 640 or a series of acts for drilling management, in accordance with at least one embodiment of the present disclosure. While FIG. 6 illustrates acts according to one embodiment, alternative embodiments may omit, add to, reorder, and/or modify any of the acts shown in FIG. 6. The acts of FIG. 6 can be performed as part of a method. Alternatively, a computer-readable medium can comprise instructions that, when executed by one or more processors, cause a computing device to perform the acts of FIG. 6. In some embodiments, a system can perform the acts of FIG. 6.

A tool health manager may receive surface contextual data for a downhole drilling system at 642. The surface contextual data may include surface operating data, specifications regarding surface equipment, any other surface contextual data, and combinations thereof. The tool health manager may receive downhole contextual data at 644. The downhole contextual data may include downhole operating data about one or more downhole tools, downhole tool information, specifications of downhole tools, wellbore trajectory, geological information, downhole measurements, any other downhole contextual data, and combinations thereof.

The tool health manager 416 may synchronize the surface contextual data and the downhole contextual data to generate synchronized data at 646. The synchronized data may be used to prepare a historical comparison with a historical database at 648. For example, the tool health manager may include a database that includes historical data. Using the historical data, the tool health manager may review the surface contextual data and the downhole contextual data to prepare the historical comparison. The historical comparison may compare the synchronized data with other drilling data. For example, the historical comparison may compare the synchronized data with drilling data from the same wellbore, from offset wellbores, from wellbores in different basins, from theoretical and/or modeled wellbores, any other wellbores, and combinations thereof.

The historical comparison may include a similarity percentage of the synchronized data to the historical data. For example, the similarity percentage may be a representation of how close to the historical data the synchronized data is. As the similarity percentage increases, the conditions of the wellbore may get closer to the historical data. The historical data may be associated with a tool health. For example, the historical data may include an association between certain wellbore conditions and increased wear or other damage to equipment. In some examples, the historical data may include an association between certain surface and/or downhole operating data and existing wear on the downhole tool. The historical comparison may allow the tool health manager to determine whether the downhole conditions are similar to the historical conditions and/or whether the downhole is experiencing or has experienced wear.

The tool health manager may, based on the historical comparison, generate a tool health status of the downhole tool at 650. As discussed herein, the tool health status may be a representation of the level of wear and/or the operability of the downhole tool. The tool health status may be based on the historical comparison. For example, based on a particular set of measured data, historical data may indicate that the downhole tool has a certain tool health. The tool health manager may send the tool health status to a drilling operator. Using the tool health status, the tool health manager may make one or more drilling decisions. As discussed herein, this may help to increase the efficiency and/or effectiveness of the downhole drilling system.

In accordance with at least one embodiment of the present disclosure, the tool health manager may further generate a drilling recommendation. The drilling recommendation may include a recommendation to take one or more drilling actions. For example, as discussed herein, the drilling recommendation may include a recommendation to adjust one or more drilling parameters and/or operating conditions In some embodiments, the downhole drilling system may perform downhole drilling activities. The surface contextual data and the downhole contextual data may be based on the downhole drilling activities. In some embodiments, the method may include implementing the drilling recommendation with the downhole drilling activities. The downhole drilling activities may include any type of downhole drilling activities, such as drilling, reaming, and other downhole drilling activities.

In some embodiments, the tool health manager may generate a confidence factor. In some embodiments, the confidence factor may be a status confidence factor of the tool health status. The status confidence factor may be a representation of the closeness of the fit of the historical comparison. For example, the status confidence factor may be a representation of the similarity percentage of the similarity between the measured conditions and the historical data. In some embodiments, the status confidence factor may be a percentage. In some embodiments, the status confidence factor may be categorized into categories, such as color-coded categories based on the level of confidence.

In some embodiments, the confidence factor may be a recommendation confidence factor of the drilling recommendation. For example, the recommendation confidence factor may be a representation of the level of confidence that the recommended actions may reach the stated goals. For example, the drilling recommendation may be a recommendation to drill to the target depth, and the recommendation confidence factor may be a representation of whether drilling with the existing tool having the existing tool health status may reach the target depth. In some examples, the drilling recommendation may be a recommendation to extend the life of the downhole tool, and the recommendation confidence factor may be a representation of the level of confidence that the drilling recommendation may extend the life of the downhole tool.

In some embodiments, the confidence factor may be adjusted based on one or more operation decisions made by the drilling operator. For example, if the drilling operator implements the drilling recommendation, the confidence factor may be adjusted based on the results of the implemented operating decision. In some examples, if the implemented drilling recommendation does not achieve the drilling goals, the confidence factor may be adjusted down. In some examples, if the implemented drilling recommendation reaches the drilling goals, the confidence factor may be adjusted up.

In some embodiments, the confidence factor may be adjusted for a single run. For example, if one or more of the implemented drilling recommendations improve the drilling conditions, improve ROP, reduce operating costs, or otherwise improve the achievement of the goals of the wellbore, the confidence factors for future drilling recommendations for the run may be increased based on an indication that the current wellbore and equipment setup is similar to the historical data used in the historical comparison. In some examples, if the implemented drilling recommendations increase wear on the downhole tool, decrease the tool health status, increase operating costs, or other reduce or hinder the achievement of the goals of the wellbore, the confidence factor for future drilling recommendations for the run may be decreased based on the indication that the current wellbore and equipment setup is not similar to the historical data used in the historical comparison.

In some embodiments, the confidence factor may be adjusted over an implementation window. The implementation window may provide a period of time and/or drilling distance over which the implementation of the drilling recommendation may be realized in the downhole drilling system. For example, some drilling recommendations may take a period to time to implement (e.g., the implementation window). Adjusting the confidence factor during this implementation window may generate a false indication of the effectiveness of the drilling window. Waiting to adjust the confidence factor until after the implementation window has passed may allow the drilling recommendation to have been fully implemented, thereby allowing the adjustment to be representative of the effectiveness of the recommendation.

In some embodiments, the tool health manager may provide the drilling recommendation and/or tool health status to the drilling operator when the confidence factor exceeds a confidence threshold. If the confidence factor is below a confidence threshold, then the recommendation may not result in the desired benefit. Only providing the drilling recommendation and/or tool health status to the drilling operator when the confidence factor exceeds the confidence threshold may help to ensure that the implemented drilling recommendations are effective.

In some embodiments, as discussed herein, the downhole tool may at least partially process the downhole operating data downhole. For example, the downhole tool may prepare a downhole portion of the drilling recommendation. The downhole portion may be based on the downhole operating data and/or any context stored on the downhole tool, such as wellbore trajectory information, location information, wellbore design information, geologic information, any other information, and combinations thereof. Pre-processing the downhole portion at the downhole tool may help to reduce the amount of data transmitted uphole. Transmission bandwidths uphole are often limited. By pre-processing the downhole portion at the downhole tool, the downhole tool may help to improve the quality of data transmitted to the surface.

As mentioned, FIG. 7 is a flowchart of a method 760 or a series of acts for drilling management, in accordance with at least one embodiment of the present disclosure. While FIG. 7 illustrates acts according to one embodiment, alternative embodiments may omit, add to, reorder, and/or modify any of the acts shown in FIG. 7. The acts of FIG. 7 can be performed as part of a method. Alternatively, a computer-readable medium can comprise instructions that, when executed by one or more processors, cause a computing device to perform the acts of FIG. 7. In some embodiments, a system can perform the acts of FIG. 7.

A RTHA system may perform downhole drilling activities using surface equipment and a downhole tool at 762. The downhole drilling activities may include any type of downhole drilling activity, such as drilling, reaming, casing cutting, cutting a dogleg, any other downhole drilling activity, and combinations thereof. The RTHA system may collect surface operating information from the surface equipment using one or more surface sensors at 764. For example, the surface sensors may collect any type of surface operating information, including surface drilling parameters. The RTHA system may collect downhole operating information from the downhole tool using one or more downhole sensors at 766. For example, the downhole sensors may collect any type of downhole operating information, including downhole drilling parameters.

Using the surface operating information and the downhole operating information, the RTHA system 400 may generate a tool health status for the downhole tool at 768. As discussed herein, the tool health status may be a representation of the health or operating capacity of the downhole tool. Using the tool health status, the RTHA system may generate a drilling recommendation including an adjustment to a drilling parameter of one or both of the surface equipment or the downhole tool at 770.

In some embodiments, the RTHA system may implement the drilling recommendation in the downhole drilling system. In some embodiments, generating the tool health status may include generating a forecast of the tool operating life of the downhole tool. In some embodiments, generating the forecast of the tool operating life may include generating the forecast of the tool operating life to the end of the run.

The embodiments disclosed in this disclosure are to help explain the concepts described herein. This description is not exhaustive and does not limit the claims to the precise embodiments disclosed. Modifications and variations from the exact embodiments in this disclosure may still be within the scope of the claims.

Likewise, the steps described need not be performed in the same sequence discussed or with the same degree of separation. Various steps may be omitted, repeated, combined, or divided, as appropriate. Accordingly, the present disclosure is not limited to the above-described embodiments, but instead is defined by the appended claims in light of their full scope of equivalents. In the above description and in the below claims, unless specified otherwise, the term "execute" and its variants are to be interpreted as pertaining to any operation of program code or instructions on a device, whether compiled, interpreted, or run using other techniques.

The claims that follow do not invoke section 112(*f*) unless the phrase "means for" is expressly used together with an associated function.

What is claimed is:

1. A method implemented at a downhole drilling system, comprising:

receiving surface contextual data of the downhole drilling system, wherein the surface contextual data is representative of surface conditions, operation of surface equipment, or both, at first respective measurement times during a drilling operation;

receiving downhole contextual data of the downhole drilling system, the downhole contextual data including downhole operating data for a downhole tool at second respective measurement times during the drilling operation;

merging the downhole contextual data with the surface contextual data based on the first respective measurement times and the second respective measurement times, such that the surface contextual data and the downhole contextual data are synchronized by using a common time, to generate the merging of the downhole contextual data with the surface contextual data;

preparing a historical comparison between historical data and the merging of the downhole contextual data with the surface contextual data; and based on the historical comparison, generating a tool health status of the downhole tool.

2. The method of claim 1, further comprising:

based on the tool health status, generating a drilling recommendation to change one or more drilling parameters.

3. The method of claim 2, further comprising:

performing downhole drilling activities with the downhole drilling system, wherein the surface contextual data and the downhole contextual data are based on the downhole drilling activities; and implementing the drilling recommendation with the downhole drilling activities.

4. The method of claim 2, wherein generating the drilling recommendation includes generating a confidence factor of one or both of the drilling recommendation or the tool health status.

5. The method of claim 4, further comprising:

adjusting the confidence factor based on an operation decision from a drilling operator.

6. The method of claim 5, wherein adjusting the confidence factor includes adjusting the confidence factor for a single run of the downhole drilling system, adjusting the drilling recommendation based on the operation decision, adjusting the confidence factor over an implementation window, or any combination thereof.

7. The method of claim 4, further comprising:

providing the drilling recommendation to a drilling operator when the confidence factor exceeds a confidence threshold.

8. The method of claim 2, further comprising:

receiving contextual data, the contextual data including equipment specifications, wellbore design information, geologic information, and wherein generating the drilling recommendation includes generating the drilling recommendation based at least in part on the contextual data.

9. The method of claim 2, wherein generating the drilling recommendation includes:

preparing a downhole portion of the drilling recommendation at the downhole tool; and combining the downhole portion and with the surface contextual data to generate the drilling recommendation.

10. The method of claim 2, wherein the drilling recommendation includes increasing in at least one of WOB, RPM, or drilling fluid flow rate.

11. A method implemented at a downhole drilling system, the method comprising:

performing downhole drilling activities using surface equipment and a downhole tool;

collecting surface operating data from the surface equipment using one or more surface sensors, wherein the surface operating data is representative of surface conditions, operation of the surface equipment, or both, at first respective measurement times during the drilling activities;

collecting downhole operating data from the downhole tool using one or more downhole sensors at second respective measurement times during the drilling activities;

merging the surface operating data with the downhole operating data based on the first respective measurement times and the second respective measurement times, such that the surface operating data and the downhole operating data are synchronized by using a common time, to generate the merging of the surface operating data with the downhole operating data;

generating a tool health status for the downhole tool based on the merging of the surface operating data with the downhole operating data; and using the tool health status, generating a drilling recommendation including an adjustment to a drilling parameter of one or both of the surface equipment or the downhole tool.

12. The method of claim 11, wherein generating the tool health status includes generating a forecast of tool operating life.

13. The method of claim 12, wherein generating the forecast includes generating the forecast to an end of a run.

14. A downhole drilling system, comprising:

surface equipment;

a downhole tool; and a processor and memory, the memory including instructions executable by the processor that cause at least one of the processor or the surface equipment to:

receive surface contextual data of the downhole drilling system, wherein the surface contextual data is representative of surface conditions, operation of the surface equipment, or both, at first respective measurement times during a drilling operation;

receive downhole contextual data of the downhole drilling system, the downhole contextual data including downhole operating data of the downhole tool at second respective measurement times during the drilling operation;

merge the downhole contextual data with the surface contextual data based on the first respective measurement times and the second respective measurement times, such that the surface contextual data and the downhole contextual data are synchronized by using a common time, and thereby generate the merging of the downhole contextual data with the surface contextual data;

prepare a historical comparison between historical data and the merging of the downhole contextual data with the surface contextual data; and based on the historical comparison, generate a tool health status of the downhole tool.

15. The downhole drilling system of claim 14, wherein the instructions are executable by the processor to, based on the tool health status, generate a drilling recommendation to change one or more drilling parameters.

16. The downhole drilling system of claim 15, wherein the instructions are executable by the processor to implement the drilling recommendation with one or both of the surface equipment or the downhole tool.

17. The downhole drilling system of claim 15, wherein generating the drilling recommendation includes generating a confidence factor of one or both of the drilling recommendation or the tool health status.

* * * * *